US005408730A

United States Patent [19]

Yamamoto

[11] Patent Number: 5,408,730

[45] Date of Patent: Apr. 25, 1995

[54] DRAW-TEXTURING MACHINE AND METHOD FOR OPERATING THE SAME

[75] Inventor: Shigeru Yamamoto, Matsuyama, Japan

[73] Assignee: Teijin Seiki Co., Ltd., Osaka, Japan

[21] Appl. No.: 101,064

[22] Filed: Aug. 3, 1993

[30] Foreign Application Priority Data

Aug. 8, 1992 [JP] Japan ..... 4-232768

[51] Int. Cl.[6] ..... D02J 1/22

[52] U.S. Cl. ..... 28/242; 28/240; 28/220; 28/249

[58] Field of Search ..... 28/240, 241, 242, 220, 28/247, 248, 249; 57/287, 288, 290, 40.5, 40.6, 164; 264/40.7, 40.6

[56] References Cited

U.S. PATENT DOCUMENTS

| | | | |
|---|---|---|---|
| 3,785,062 | 1/1974 | Finley et al. | 28/24.1 |
| 4,295,360 | 10/1981 | Fountain | 73/15.6 |
| 4,404,718 | 9/1983 | Tajiri | 28/241 |
| 4,611,410 | 9/1986 | Brossmer | 28/172.2 |
| 4,669,159 | 6/1987 | Bogucki et al. | 28/172.2 |
| 4,852,225 | 8/1989 | Hagewood | 28/242 |
| 4,905,468 | 3/1990 | Tanae | 57/284 |
| 4,916,783 | 4/1990 | Hagewood | 28/172.1 |
| 4,961,308 | 10/1990 | Braxmeier . | |
| 5,179,828 | 1/1993 | Stahlecker . | |

FOREIGN PATENT DOCUMENTS

| | | |
|---|---|---|
| 3729426 | 3/1989 | Germany . |
| 3938679 | 5/1991 | Germany . |

OTHER PUBLICATIONS

Patent Abstracts of Japan, vol. 005, No. 020 (C-042) 6 Feb. 1981.

*Primary Examiner*—Clifford D. Crowder
*Assistant Examiner*—Larry D. Worrell, Jr.
*Attorney, Agent, or Firm*—Rothwell, Figg, Ernst & Kurz

[57] ABSTRACT

A draw texturing machine, which is provided with a heater to be set at a temperature higher than a melting point of a yarn to be textured, can be stopped in operation while the yarn is being threaded onto the machine and then re-started. The temperature of the heater is lowered upon stoppage of the machine, the temperature of the heater is detected, and the rotating speeds of rotating members are controlled based on the detected temperature. An effective method is provided by which a draw texturing machine provided with a heater to be set at a temperature higher than a melting point of a yarn to be textured can be stopped and then re-started while the yarn is being threaded.

8 Claims, 3 Drawing Sheets

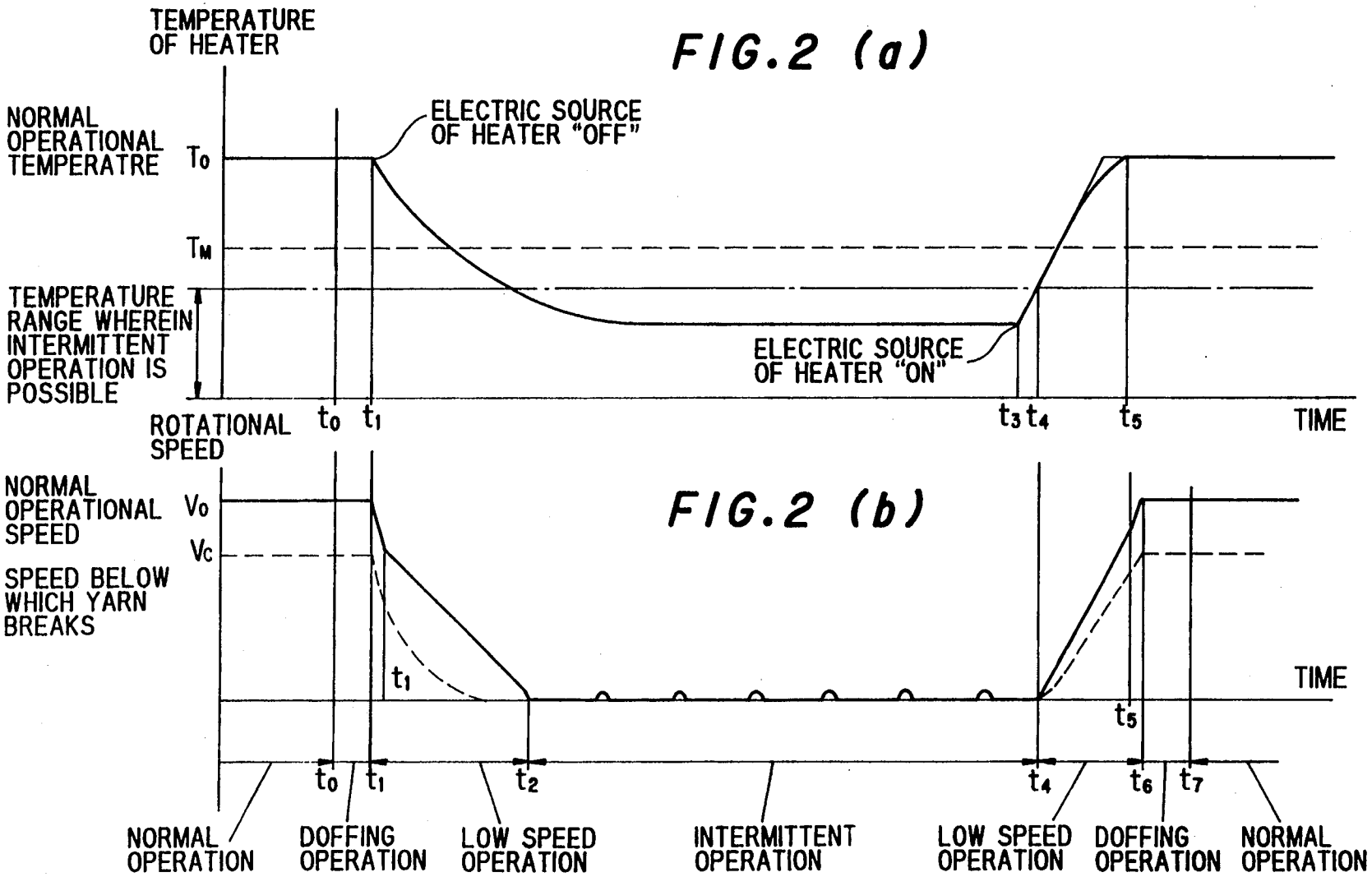
FIG. 2 (a)
TEMPERATURE OF HEATER
NORMAL OPERATIONAL TEMPERATRE
To
TM
TEMPERATURE RANGE WHEREIN INTERMITTENT OPERATION IS POSSIBLE
ELECTRIC SOURCE OF HEATER "OFF"
ELECTRIC SOURCE OF HEATER "ON"
ROTATIONAL SPEED
NORMAL OPERATIONAL SPEED
Vo
SPEED BELOW WHICH YARN BREAKS
Vc
TIME
to
t1
t3
t4
t5
FIG. 2 (b)
TIME
to
t1
t2
t4
t5
t6
t7
NORMAL OPERATION
DOFFING OPERATION
LOW SPEED OPERATION
INTERMITTENT OPERATION
LOW SPEED OPERATION
DOFFING OPERATION
NORMAL OPERATION

DRAW-TEXTURING MACHINE AND METHOD FOR OPERATING THE SAME

BACKGROUND OF THE INVENTION

1. Field of the Invention

The present invention relates to a method for operating a draw-texturing machine, wherein an undrawn yarn (UDY) or a partially drawn yarn (POY) of synthetic fibers, such as polyester or polyamide, is false-twisted simultaneously with or sequentially after the drawing operation, and a draw-texturing machine for effecting the method.

2. Description of Prior Art

A draw-texturing machine occasionally has to be stopped for maintenance service, holidays, etc. Conventionally, upon stoppage of such a draw-texturing machine, a yarn which has been threaded onto the machine is cut, and a re-threading operation is carried out upon re-starting of the draw-texturing machine. A typical draw-texturing machine is provided with a plurality of yarn processing portions, i.e., it usually has about 200 spindles, and a threading operation requires a considerable amount of time, in general, 2 to 3 hours (by 4 to 6 persons). If a draw-texturing machine can be stopped while the yarn is being threaded thereonto and can be re-started, the above-described threading operation can be omitted. Accordingly, human labor can be reduced. Further, the length of down time wherein the draw-texturing machine has to be stopped can be shortened, and the economical efficiency of the draw-texturing machine will be enhanced.

In a conventional draw-texturing machine, the temperature of the heater is generally set at a temperature lower than a melting point of a yarn to be textured. In such a conventional draw-texturing machine, the machine can be stopped and re-started by controlling the rotating speed of the rotating members regardless of the set temperature of the heater.

However, in a draw-texturing machine which is provided with a heater to be set at a temperature a higher than a melting point of a yarn to be textured, e.g., higher than 400° C. when the texturing speed becomes lower than a certain speed upon stoppage of the machine, the yarn may be melted within the heater since the temperature of the heater is high, and yarn breakages may occur. Thus, there is a problem in that the machine cannot be stopped or re-started while the yarn is being threaded onto the machine.

It is an object of the present invention to provide a method by which a draw-texturing machine, which is provided with a heater to be set at a temperature higher than a melting point of a yarn to be textured, can be stopped and re-started while the yarn is threaded onto the machine.

It is another object of the present invention to provide a draw-texturing machine by which the method can be performed effectively.

SUMMARY OF THE INVENTION

According to the present invention, the object is achieved by a method for stopping and re-starting a draw-texturing machine which is provided with a heater to be set at a temperature higher than a melting point of a yarn to be textured and has rotating members mounted thereon, characterized in that the machine is stopped while the yarn is threaded onto the machine and a temperature of the heater is lowered upon stoppage of the machine. The machine is re-started while a temperature of the heater is detected, and rotating speeds of the rotating members are controlled based on the detected temperature.

Further, as an apparatus for effecting the method, the present inventors includes a draw-texturing machine which is provided with a heater to be set at a temperature higher than a melting point for a yarn to be textured and has rotating members mounted thereon, characterized in that the machine comprises a drive source for the rotating members provided with a variable speed change means, and a micro-computer capable of detecting a temperature of the heater and controlling the temperature at a predetermined value and speeds of the rotating members. The micro-computer has input therein a lower limit speed of the rotating members depending on the temperature of the heater, and the machine can be driven at the lower limit speed during speeding up and speeding down while the yarn is being threaded onto the machine.

According to the present invention, the set temperature of the heater is lowered upon stoppage of the draw-texturing machine, the temperature of the heater is detected, and the rotating speeds of the rotating members are controlled based on the detected temperature. Thus, the draw-texturing machine can be stopped while the yarn is threaded onto the machine. Further, since the yarn is kept threaded onto the machine, the machine can be re-started without effecting a re-threading operation.

The critical temperature of the heater, on which a yarn is melted, depends on factors such as (1) the length of the heater, (2) the kind (material, thickness) of yarn, and (3) the speeds of the rotating members. Among these factors, the length of the heater described in item (1) is constant depending on the type of the draw-texturing machine. Accordingly, if the temperature of the heater and the kind of the yarn are known, the lower limits of the rotating speeds which are acceptable for the rotating members can be known calculated.

Further, generally speaking, one draw-texturing machine deals with one kind of yarn. Accordingly, if the temperature of the yarn is known, the speeds of the rotating members when the yarn begins to be melted can be obtained. Thus, when the rotating speeds of the rotating members are controlled (depending on the temperature of the heater) at speeds lower than the critical speeds at which the yarn begins to be melted, the draw-texturing machine can be stopped without causing any yarn breakage. Further, after re-start, since the temperature of the heater is raised, the temperature of the heater is detected and the rotating speeds of the rotating members are controlled based on the detected temperature and raised to predetermined normal speeds.

The following matters have to be taken into consideration with respect to the rotating speeds of the rotating members set at this time. If the rotating speeds of the rotating members deviate from those at the normal operating conditions, the yarn which has been processed during this time has to be considered wasted yarn. Accordingly, the shorter the time required during stoppage and start of the draw-texturing machine, the more effective the draw-texturing machine is. Since the time required for heating up or cooling down the temperature of the heater is comparatively long, it is preferable that the speed during this heating up or cooling down operation be set low as long as there occurs no yarn breakage so that the amount of the yarn processed during this time, i.e., the amount of wasted yarn, is minimized.

When the above-described method is carried out, data relating to the minimum speeds with respect to the temperatures of the heater are previously input to a computer. In other words, data depending on the brand of the yarn are stored, and the operating speeds are varied by detecting the temperature of the heater.

Further, though the temperature of the heater is lower than the yarn melting point, if it is still relatively high, a portion of a yarn within the heater may be deteriorated due to the heat, when i.e., the same portion of the yarn is exposed to a high temperature for a relatively long time while the machine is stopped. The deteriorated portion of the yarn may be broken upon re-starting of the machine. In order to obviate such a problem, during the time wherein the temperature of the heater is lower than the melting point of the yarn, for example, about 255° C. in the case of polyester, and in actuality, at a temperature remarkably lower than the melting point, for example, lower than 200° C., the draw-texturing machine may be operated intermittently.

The conditions wherein yarn breakages are observed depend on the temperature of the heater and the kind of yarn, i.e., its material and thickness. For example, when a polyester yarn of 75 denier is kept at 150° C., the yarn is broken after 2 hours. The interval of the intermittent operation, i.e., the operating time and stopping time, may be changed depending on the temperature of the heater, and may be always constant in some cases.

When the spindles of the draw-texturing machine are provided with automatic doffing devices, respectively, the electric source of the heater may be switched off after the doffing operation of the last spindle has been completed, and the speeding down of the machine may be done in accordance with the above-described method. Further, at a predetermined start time, the heater may be automatically switched on so as to start the machine, and when the temperatures of all the heaters of all the spindles reach a set temperature, the rotating speeds of the rotating members are raised to the normal operating speeds, and then the doffing operation may be carried out again. Thus, wasted yarn created when the operating speed of the draw-texturing machine is deviated from the normal speed can be wound in packages and removed.

BRIEF DESCRIPTION OF THE DRAWINGS

An embodiment of the present invention will now be described in detail with reference to the accompanying drawings, wherein:

FIGS. 2(*a*) and 2(*b*) are diagrams showing an operational method of the present invention, wherein FIG. 2(*a*) shows a relationship between heater temperatures and time, and FIG. 2(*b*) shows a relationship between rotating speeds of the rotating members and time.

DETAILED DESCRIPTION OF THE PREFERRED EMBODIMENTS

Figure 1:
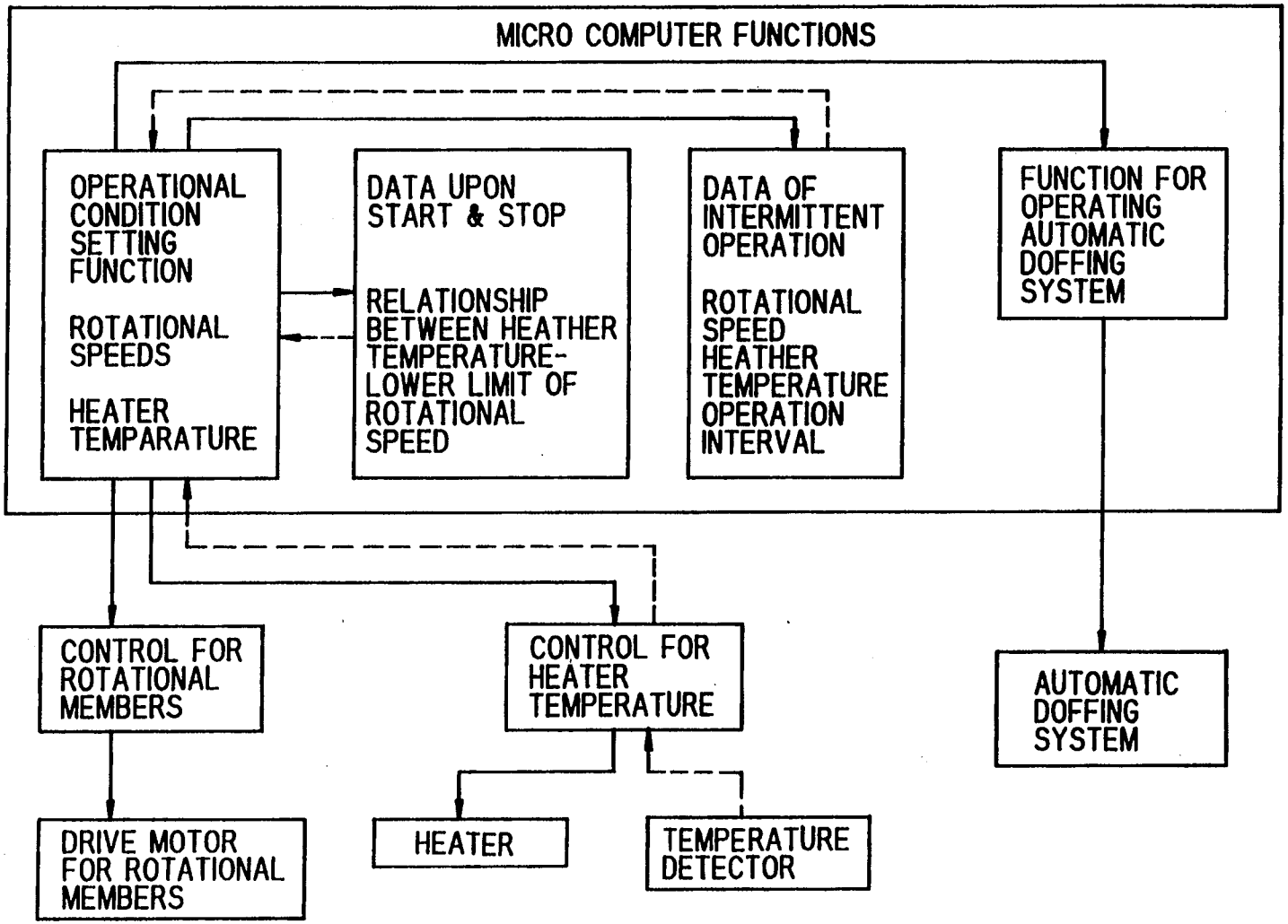
FIG. 1 is a diagram of the control device of the present invention.

FIG. 1 is a diagram of the control system of a draw-texturing machine of the present invention. In the draw-texturing machine of the embodiment of the present invention, a partially oriented yarn (POY) of synthetic fibers, such as polyester or polyamide, is drawn and simultaneously false-twisted. However, according to the present invention, an undrawn yarn (UDY) of synthetic fibers, such as polyester or polyamide, may be drawn and simultaneously/false-twisted. Further, a partially oriented yarn (POY) or an undrawn yarn (UDY) of synthetic fibers, such as polyester or polyamide, may be false-twisted sequentially after being.

A computer installed in the draw-texturing machine according to the present invention is provided with micro computer functions as described.

A function for setting operational conditions is illustrated at the left in FIG. 1. This function includes setting of rotating speeds of the rotational members, temperature of the heater or the like under the normal conditions, and during start-up and stoppage of the machine. The operational condition setting function also includes controlling the rotational speeds of the rotational members and the temperature of the heater under the normal conditions.

As described above, data relating to the minimum speeds with respect to the temperatures of the heater depending on the brand of the yarn are previously stored in the computer. The operational condition setting function sets the operational condition based on this data.

Further, data relating to the intermittent operation of the machine are stored so as to prepare a case wherein the temperature is lowered to a temperature lower than the melting point of the yarn to be textured. The data may be the temperature of the heater, the interval of the intermittent operation or the like.

In addition, when the draw-texturing machine is provided with an automatic doffing device, a function for operating the doffing device is installed in the micro computer as one of the micro computer functions.

The operational condition setting function includes receipt of signals from a temperature detector mounted on the heater, calculation of the rotational speeds of the rotating members based on the detected signal, and transmission of control signals relating to optional speed to a control device for the rotating members. The rotational speeds of the rotating members are controlled at the optional speeds based on the control signals. Although it is not illustrated in FIG. 1, signals relating to the rotational speeds of the rotating members may be fed-back.

The detected temperature of the heater is transmitted to the operational condition setting function from the temperature detector through a heater temperature controlling device, and the heater temperature is controlled at a predetermined temperature based on the signals from the operational condition setting function.

An example of an operational method of the draw-texturing machine of the present invention will now be explained with reference to FIGS. 2(*a*) and 2(*b*). FIG. 2(*a*) illustrated at the upper portion shows a relationship between heater temperature plotted on the ordinate and time plotted on the abscissa; and FIG. 2(*b*) shows a relationship between rotating speed of the rotating members plotted on the ordinate and time plotted on the abscissa. The abscissas in FIGS. 2(*a*) and 2(*b*) correspond to each other. In other words, the same position on the abscissas means the same time.

As illustrated in FIG. 2(*a*), the temperature of the heater is set at a normal temperature $T_o$, i.e., a temperature much higher than the melting point of the yarn to be textured, for example, 400° C. or higher, during the normal operation of the draw-texturing machine. The rotating members are driven at a normal operational speed $V_o$ while the heater is set at the normal operational temperature. The normal operational speed $V_o$ is set higher than a critical speed $V_c$ below which the yarn processed at the normal operational speed $V_o$ may become broken.

At the end of the normal operation (time between $t_0$ to $t_1$), a doffing operation is carried out by means of the automatic doffing system. After completion of the doffing operation, the electric source for the heater is turned off first (at time $t_1$), and the temperature of the heater is lowered as illustrated in FIG. 2(*a*). The temperature of the heater during lowering of the temperature thereof is detected by the temperature detector, and the rotational speeds of the rotating members are set at acceptable speeds which are determined based on the detected heater temperature, and thus, the rotational speeds are decreased (time between $t_1$ to $t_2$) as indicated by a solid line in FIG. 2(*b*). It is preferred that the rotational speeds of the rotating members be rapidly decreased (time between $t_1$ to $t_1'$) upon turning off the electric source so that the amount of wasted yarn is reduced. In this case, the rapidly decreased rotating speeds of the rotational members are set higher than the critical speed determined with respect to the heater temperature which speed is indicated by a broken line in FIG. 2(*b*) and below which a yarn may become broken.

As described above, the rotational speeds of the rotating members are decreased in accordance with lowering of the heater temperature, and accordingly, the draw-texturing machine can be brought to a standstill (at time $t_2$) without causing any yarn breakages while the yarn is being threaded onto the draw-texturing machine. The draw-texturing machine may be kept at a standstill (time between $t_2$ and $t_4$) until it is re-started. However, as described above, though the temperature of the heater is lower than the melting point, a portion of a yarn within the heater may be deteriorated when the same portion is exposed to a relatively high temperature for a relatively long time while the machine is stopped, and the deteriorated portion may be broken upon re-starting the machine. In order to obviate such a problem, as illustrated in FIG. 2(*b*), the rotational members of the draw-texturing machine may be operated intermittently. The interval of the intermittent operation and the operating time may be constant as illustrated in FIG. 2(*b*). However, they may also be varied.

Upon re-starting of the draw-texturing machine, as illustrated in FIG. 2(*a*), the heater is turned on (at time $t_3$). The temperature of the heater has reached is detected by the heater temperature detector, and after it has been confirmed that the temperature of the heater has reached a predetermined temperature, which is set to an upper limit wherein the intermittent operation is possible in the example illustrated in FIGS. 2(*a*) and 2(*b*), the rotating members are started (at time $t_4$), and their rotational speeds are increased to speeds depending on the temperature of the heater (time between $t_4$ and $t_5$) taking into consideration the latter. When it is confirmed that the temperature of the heater has reached a predetermined value (at time $t_5$), the rotating speeds of the rotational members are rapidly increased (time between $t_5$ and $t_6$) to normal operational speeds $V_0$ which are higher than the critical speed indicated by broken line $V_c$ in FIG. 2(*b*), below which yarn breakages may occur easily, so that generation of wasted yarn is minimized.

Although in the above-described embodiment the electric source of the heater is switched off upon stoppage of the draw-texturing machine, the temperature of the heater may be set at a predetermined temperature which is lower than a melting point of a yarn to be textured, for example, 150° C. in case of a polyester yarn. If the heater is kept at a temperature lower than the yarn melting point upon stoppage of the draw-texturing machine, the temperature of the heater is set at a normal operational temperature in place of switching on upon re-start of the draw-texturing machine.

Further, a doffing operation is carried out after the temperature of the heater reaches the normal operational temperature so that the wasted yarn generated during time wherein the yarn processing speed of the draw-texturing machine is deviated from the normal operational speed is removed. Thereafter, a normal winding operation is carried out.

According to the present invention, the temperature of the heater is lowered upon stoppage of the draw-texturing machine, the temperature of the heater is detected, and the rotating speeds of the rotating members are controlled based on the detected temperature. Thus, the draw texturing machine provided with a heater to be set at a temperature higher than a melting point of a yarn to be textured can be stopped while the yarn is threaded, and it can be re-started without effecting a re-threading operation since the yarn has been kept threaded.

Figure 3:
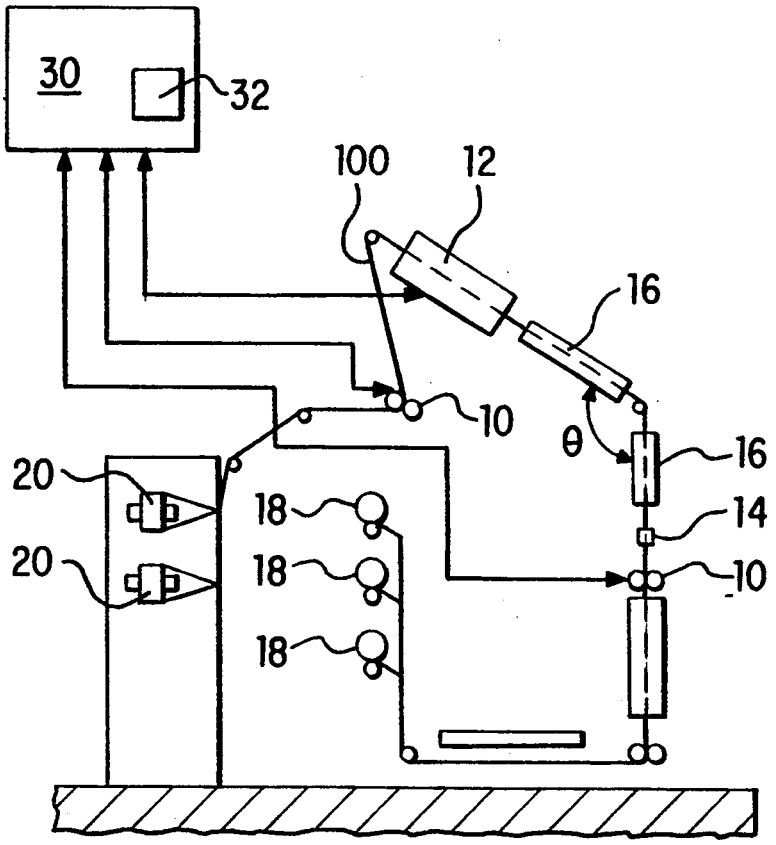
FIG. 3 depicts a draw featuring machine of the present invention.

FIG. 3 depicts a draw-texturing machine according to the present invention which includes a plurality of rotating members 10 for feeding the yarn 100, at least one heater 12 capable of being heated to a temperature higher than the yarn melting point, a drive source (not shown) for members 10, a twisting unit 14 for imparting twists to the yarn, stabilizing tracks 16, yarn take-up reels 18 and a yarn supply 20. The microcomputer which controls the heater and rotating members is indicated schematically at 30 and is shown to include a memory 32.

What we claim is:

1. A method for stopping and restarting a draw-texturing machine while a yarn is threaded thereon such that the yarn does not break during said stopping and restarting of the machine, the machine having a heater and a plurality of rotating members for feeding the yarn, the rotating members being driven by a drive source, the method comprising steps of:

providing said draw-texturing machine with means for controlling the temperature of the heater, a sensor for detecting the temperature of the heater, and means for controlling the rotational speed of the rotating members;

storing data in a memory of said draw-texturing machine regarding the relationship between heater temperatures and respective corresponding critical rotational speeds of the rotating members, such that if the rotational speed of the rotating members falls below a critical speed for a corresponding heater temperature the yarn may become melted and broken;

operating said draw-texturing machine with the heater set at a temperature greater than the melting point of the yarn being treated;

stopping the operation of said draw-texturing machine by:

(i) lowering the temperature of the heater;

(ii) detecting the temperature of the heater during said step of lowering the temperature thereof; and (iii) controllably lowering the speed of the rotating members in response to the detected heater temperature and based on the stored data regarding the relationship between the critical rotational speed of the rotating members and the temperature of the heater until the rotating members are stopped such that the yarn is prevented from melting and breaking due to said lowering of the speed of the rotating members; and restarting said draw-texturing machine by raising the temperature of the heater and detecting the heater temperature during said raising thereof, and increasing the speed of the rotating members in conjunction with said raising of the heater temperature until the heater temperature reaches a predetermined set temperature and the rotating members reach a desired normal operating speed.

2. A method as claimed in claim 1, wherein the heater temperature is lowered during stoppage of the draw-texturing machine by shutting off a power source for the heater.

3. A method as claimed in claim 1, wherein during the time between the stoppage of the rotating members and restarting of the draw-texturing machine, the rotating members are intermittently operated to prevent deterioration of the yarn due to prolonged exposure to the heater.

4. A method as claimed in claim 1, wherein the speed of the rotating members is lowered rapidly to reduce the amount of wasted yarn while still preventing the yarn from being melted by the heater.

5. A method as claimed in claim 1, wherein said draw-texturing machine is provided with an automatic yarn doffing device for automatically performing a doffing operation before the stopping of said draw-texturing machine and after the restarting of said draw-texturing machine.

6. A draw-texturing machine the operation of which may be stopped and restarted while a yarn is threaded thereon without breakage of the yarn, the apparatus comprising:

a heater and means for heating said heater to a temperature higher than a melting point of a yarn being treated by said draw-texturing machine;

a plurality of rotating members for feeding the yarn through the machine and a drive source for driving said rotating members, said drive source being provided with variable speed change means for varying the rotational speed of the rotating members;

a microcomputer connected to a temperature detector for detecting a temperature of said heater and to said means for heating the heater to controllably heat said heater, said microcomputer also being connected to said drive source for controllably driving the rotating members; and said microcomputer having a memory in which is stored data regarding the relationship between heater temperatures and respective corresponding critical rotational speeds of the rotating members, such that if the rotational speed of the rotating members falls below a critical speed for a corresponding heater temperature the yarn may become melted and broken;

whereby said draw-texturing machine may be stopped, the temperature of said heater lowered while being detected and input to said microcomputer, and the rotational speed of said rotating members controllably reduced to zero by said microcomputer in response to the detected heater temperature and the stored data so as to prevent the yarn from becoming melted, and whereby the draw-texturing machine may be restarted while the yarn is threaded thereon without said yarn breaking.

7. A method as claimed in claim 6, wherein said microcomputer has input therein a program for intermittently driving said rotating members during the stoppage of the draw-texturing machine to prevent deterioration of the yarn due to prolonged exposure to said heater.

8. A method as claimed in claim 6, wherein said draw-texturing machine is provided with an automatic yarn doffing device for automatically performing a doffing operation before the stopping of said draw-texturing machine and after the restarting of said draw-texturing machine.

* * * * *

UNITED STATES PATENT AND TRADEMARK OFFICE

CERTIFICATE OF CORRECTION

PATENT NO. : 5,408,730

DATED : April 25, 1995

INVENTOR(S) : Shigeru Yamamoto

It is certified that error appears in the above-indentified patent and that said Letters Patent is hereby corrected as shown below:

In the Abstract: Line 3, after "in" insert -- its --;

Col. 2, line 6, "inventors" should be -- invention --; Col. 3, line 14, before "when" insert -- i.e., --; Col. 3, line 14, after "when" delete "i.e.,"; Col. 4, line 7, delete "/"; Col. 4, line 16, "rotational" should be -- rotating --; Col. 4, line 30, "prepare" should be -- permit --; Col. 5, line 27, "rotational" should be -- rotating --.

Signed and Sealed this

Twenty-eighth Day of November 1995

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,408,730

DATED : April 25, 1995

INVENTOR(S) : Shigeru Yamamoto

It is certified that error appears in the above-identified patent and that said Letters Patent is hereby corrected as shown below:

COLUMN 1

Line 41, before "higher" delete "a".

Signed and Sealed this

Sixteenth Day of July, 1996

*Attest:*

*Attesting Officer*

BRUCE LEHMAN

*Commissioner of Patents and Trademarks*